United States Patent [19]

Vann

[11] 4,125,159

[45] Nov. 14, 1978

[54] METHOD AND APPARATUS FOR ISOLATING AND TREATING SUBSURFACE STRATAS

[76] Inventor: Roy R. Vann, P.O. Box 38, Artesia, N. Mex. 88210

[21] Appl. No.: 843,152

[22] Filed: Oct. 17, 1977

[51] Int. Cl.[2] ..... E21B 33/138; E21B 43/27

[52] U.S. Cl. ..... 166/285; 166/57; 166/281; 166/302

[58] Field of Search ..... 166/285, 288, 302, 57, 166/281, DIG. 1

[56] References Cited

U.S. PATENT DOCUMENTS

| | | | |
|---|---|---|---|
| 1,342,780 | 6/1920 | Vedder | 166/302 X |
| 1,342,781 | 6/1920 | Vedder | 166/302 X |
| 2,033,560 | 3/1936 | Wells | 166/57 |
| 2,033,561 | 3/1936 | Wells | 166/57 X |
| 3,194,315 | 7/1965 | Rogers | 166/57 |
| 3,301,326 | 1/1967 | McNamer | 166/302 X |
| 3,738,424 | 6/1973 | Osmun et al. | 166/302 X |
| 3,815,957 | 6/1974 | Spedden et al. | 166/285 X |
| 3,871,448 | 3/1975 | Vann et al. | 166/128 |
| 3,885,629 | 5/1975 | Erb | 166/302 |

*Primary Examiner*—Stephen J. Novosad
*Assistant Examiner*—George A. Suchfield
*Attorney, Agent, or Firm*—Marcus L. Bates

[57] ABSTRACT

This invention relates to method and apparatus for isolating and treating one of a plurality of selected zones located downhole in a borehole by freezing spaced-apart portions of the formation so that the zone to be treated is located therebetween. Treatment fluid is pumped down the apparatus of the present invention and out into the zone to be treated, with the spaced-apart, frozen portions of the formation effectively isolating the remainder of the wellbore from the treatment zone.

11 Claims, 10 Drawing Figures

METHOD AND APPARATUS FOR ISOLATING AND TREATING SUBSURFACE STRATAS

RELATED PRIOR ART

Rogers, 3,194,315, discloses apparatus by which a selected region in a wellbore can be frozen.

BACKGROUND OF THE INVENTION

Many hydrocarbon producing wellbores have several different spaced apart production zones located a substantial distance apart from one another. Production simultaneously occurs from each of the zones and sometime it is discovered that one of the zones is not producing sufficient production fluid. Accordingly, the well is treated by isolating the suspected poor production zone and pumping acid and proping agents down the wellbore and through the perforations of the casing. Often the treated formation does not favorably respond to the chemical treatment because the treatment fluids have flowed up or down the borehole annulus rather than laterally away from the borehole and back up into the desired formation.

Sometimes the undesired flow path by which the treatment fluid flows up or downhole is closed by packing off the faulty zone and squeezing cement into the perforations, whereupon the formation must again be perforated in order to re-establish communication between the borehole and the hydrocarbon containing formation. This operation is not always successful for it does not always eliminate the cause for the loss or misplacement of the treatment fluid.

The above treatment, cement squeeze operation, and retreatment of the pay zone is very costly and often leads to the erroneous assumption that the pay is inadequate for continued production and therefore sometimes results in the loss of a considerable quantity of hydrocarbons. Overcoming the above problems is the subject of this invention.

In secondary recovery processes, injection wells are radially spaced from production wells so that water can be pumped downhole into the hydrocarbon-bearing formations in a manner which forces some of the remaining hydrocarbons radially from the injection wells and in a direction towards the production wells.

In some geographical locations, the injected water flows from the water injection well to a production well whereupon the water then flows uphole or downhole, whereupon the water becomes lost by flowing into a cavity or another formation. The water usually flows longitudinally along the casing as a result of a poor cementing job, or because of the presence of salt deposits which are solubilized by the water, thereby forming a passageway which leads to a water-accepting area. It is difficult to perforate and squeeze such a passageway in order to repair the resultant damage caused by the poor cement job because the velocity of the water flowing through the washed-out passageways or tunnels make such an operation unsuccessful. Overcoming the above problem is another subject of this invention.

SUMMARY OF THE INVENTION

This invention broadly encompasses both method and apparatus for isolating a hydrocarbon containing formation, or production zone, from other strata or similar formations, and forcing treatment fluid downhole and laterally into the production zone in a manner to prevent the treatment fluid from being lost by flowing up or downhole towards the other strata.

More specifically the invention comprises spaced insulated vessels containing $N_2$ or the like connected together by a vent assembly and lowered downhole so that the spaced vessels straddle the zone to be treated. The insulation is removed from the vessels, the vaporized $N_2$ flows from the vapor space formed within the vessels along an isolated flow path which leads into the tubing string and to the surface of the ground, thus enabling the heat of vaporization to absorb a tremendous amount of heat in proximity of the vessels, and consequently forming spaced frozen plugs of mud, formation, and formation fluids in close proximity thereof so that the zone to be treated is temporarily isolated in unfrozen condition. The vent assembly is opened, treatment fluid is forced downhole through the tubing string, through the vent assembly, laterally out into the zone to be treated, where great pressure can be exerted to open and treat and prop open the formation.

Movement of the insulation and the vent assembly can be achieved by wireline actuated tools and by employing prior art wireline retrieval techniques together with some noval aspects of the invention as specifically set forth herein.

Accordingly, a primary object of this invention is the provision of a method of isolating and treating a subsurface pay zone of a wellbore.

Another object of the invention is a method of isolating a hydrocarbon containing formation of a completed wellbore from other formations so that treatment fluid can be pumped laterally into the desired formation.

A further object of this invention is a method of freezing upper and lower marginal areas of a borehole so that a marginal length of the wellbore located between the upper and lower marginal areas can be subjected to treatment fluid under great pressures and the fluid will be forced to flow laterally away from the well in proximity of the marginal length of the borehole.

A still further object of this invention is the method and apparatus for isolating one formation of a wellbore from another formation thereof and forcing treatment chemical into the isolated borehole in such a manner that the chemical flows only into the one isolated formation.

Another and still further object of this invention is the method and apparatus for treating a hydrocarbon containing formation in a manner as set forth in the above abstract and summary.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described in the above abstract and summary.

DETAILED DESCRIPTION OF THE PREFERRED EMBODIMENT

Figure 1:
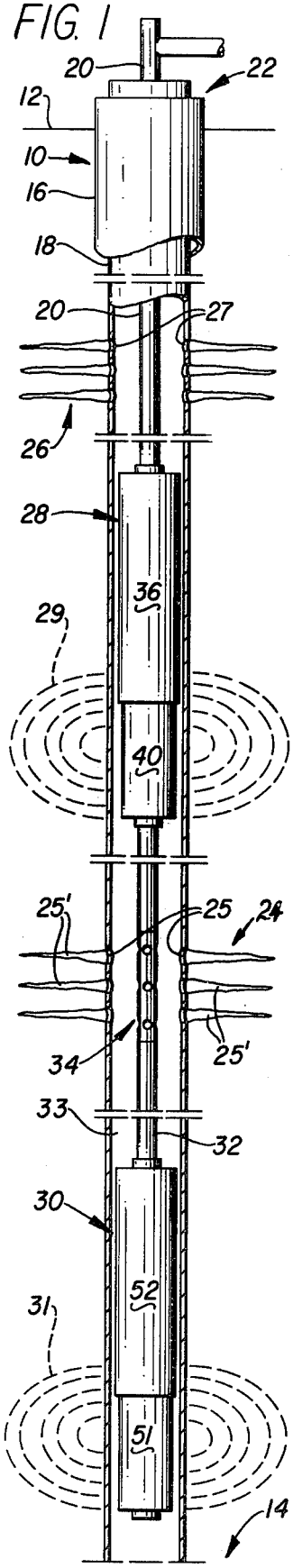
FIG. 1 is a broken, cross-sectional view of a strata of the earth, having a borehole formed therein, and apparatus made in accordance with the present invention disposed within the borehole.

In FIG. 1, there is diagrammatically illustrated in a broad manner a borehole 10 which extends from the surface 12 of the earth to some lower elevation 14. The borehole is usually provided with a surface casing 16 and an inner borehole casing 18.

Production tubing 20 connects to a Christmas tree 22 in the usual manner. The borehole communicates a production zone 24 by means of the illustrated perforations 25 formed within the casing. Numeral 25' indicates that a jet gun has perforated the casing and cement to form a plurality of lateral passageways which extend radially away from the casing and back out into the zone.

Occasionally, it is desirable to exclusively treat one production formation 24 and be certain that all of the treatment chemical is forced back up into the selected zone, rather than being wasted on other production zones at 26 and 14 which need no treatment. For this reason, it is advantageous to isolate zone 24 from the other zones 26 having similar perforations and passageways 27, so that treatment fluid can be forced back up into the exact formation 24 selected for treatment.

An upper vessel 28 made in accordance with the present invention has the capability of freezing a surrounding or contiguous area 29 of the borehole when the apparatus is utilized in accordance with the teachings of the present invention. A lower vessel 30 similarly has the capability of freezing a contiguous area 31 adjacent to the borehole when the member is manipulated in accordance with the present invention.

Members 28 and 30 are connected together by tubing 32 and forms an annulus 33 therebetween. A perforated nipple 33, preferably in the form of a vent assembly, is interposed within the tubing string 32 and includes means by which the illustrated outlet ports thereof can be moved from a normally closed into an opened position.

Figure 2:
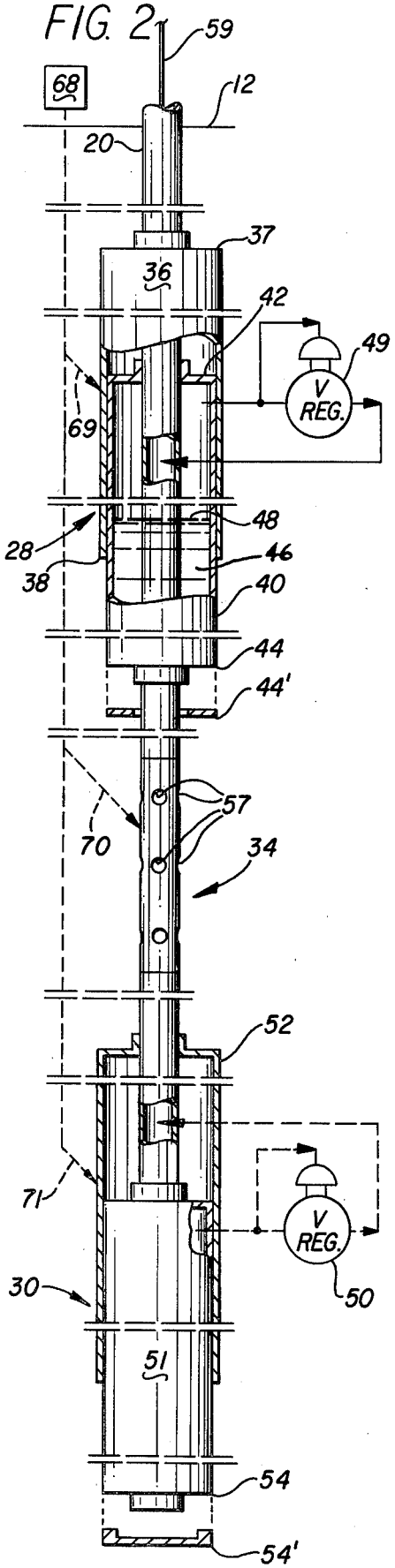
FIG. 2 is an enlarged, fragmented, part diagrammatical, part cross-sectional view of part of the apparatus disclosed in FIG. 1.

As best seen illustrated in FIG. 2, the upper vessel includes an insulated enclosure in the form of a cylinder 36. The cylinder has an upper end 37 and downwardly opens towards a lower terminal end 38 so that the cylinder provides a downwardly directed, circumferentially extending skirt. A cylindrical, stainless steel container 40 forms a pressurized vessel and includes an upper annular end wall 42, a lower annular end wall 44, thereby forming an interior chamber 46 within which liquid nitrogen is contained. The liquid level of the nitrogen is indicated by numeral 48. Hence, the liquid nitrogen has a liquid and a gaseous phase. The gaseous component of the contents of the vessel 40 is maintained at a predetermined maximum pressure with respect to its structural integrity by means of the pressure regulator valve which is schematically indicated by the numeral 49. The regulator valve is connected to the gaseous phase located in the upper chamber and controllably monitors a flow of gaseous nitrogen into the interior of the tubing string, thereby maintaining the internal pressure of the vessel at a predetermined maximum value.

The lower vessel 30 includes a similar stainless steel container 51 which forms a lower nitrogen-containing chamber similar to the container 40. The lower container is telescopingly received in a slidable manner within a lower insulated enclosure 52, which is similar to the enclosure 36. Pressure regulator valve 50 is connected to receive flow from the gaseous phase of the nitrogen contained within the lower vessel and conducts the flow of vaporized nitrogen into the interior of tubing string 32 to thereby maintain a predetermined vapor pressure within the interior of the lower container.

Figure 3:
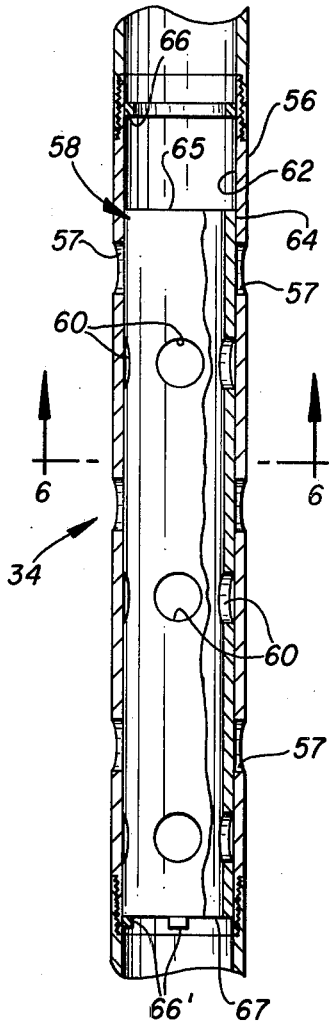
FIG. 3 is a fragmented, enlarged, cross-sectional view of part of the apparatus disclosed in the foregoing figures.
Figure 6:
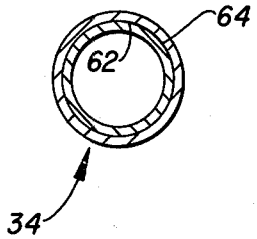
FIGS. 6, 7, and 8, respectively, are cross-sectional views taken along lines 6—6 of FIG. 3, 7—7 of FIG. 4, and 8—8 of FIG. 5, respectively.

As seen in FIGS. 1-3, the vent assembly 34 includes an outer tubular member 56 which is threadedly made up with and forms part of the tubing string 32 to thereby connect together the upper and lower spaced apart vessels and thereby form a tool string made in accordance with the present invention. Outlet ports 57 are radially spaced about the wall of the outer tubular member. A sliding sleeve 58 is provided with a plurality of radially and vertically spaced ports 60, with the ports 60 being indexed with the ports 57, so that when the sleeve is forced to slide in an upward direction, ports 57 and 60 become axially aligned with one another to thereby communicate the interior of the tubing at 32 and 20 with the annular area 33 formed between the casing, upper and lower vessels, and the vent assembly, or with the marginal length of the tubing string seen at 32 and 34 in FIG. 1, for example.

The interior 62 of the nipple and the exterior 64 of the sleeve are sealed relative to one another to preclude flow of fluid to occur from port 60 through port 57, until the latter ports are brought into registry with one another. This may be attained by any number of different expedients, but preferably by including placement of O-rings about the sleeve to seal the annulus formed between the exterior surface of the sleeve, or alternatively, by employing an extremely close tolerance fit between the walls 62 and 64.

The upper edge 65 of the sleeve can be forced to slide in an upward direction into abutting engagement with a stop means 66. The lower edge 67 of the sleeve can be similarly moved against abutment 66'. The lower edge of the sleeve can be engaged with a suitable wireline actuated fishing tool in order to force the sleeve to move in an upward direction to thereby open the ports of the sliding sleeve and perforated nipple of the vent assembly. The wireline is indicated in FIG. 2 by the numeral 59.

In FIG. 2, numeral 68 indicates any above surface means which can be employed to manipulate the upper and the lower insulator, as indicated by the numerals 69 and 71. Manipulation of the upper and lower insulated sleeve can be carried out by running a wireline down the casing annulus to engage the upper sleeve as illustrated at 69 in FIG. 2, 71' in FIG. 4 and 71 in FIG. 5, or alternatively, by employment of J-latches and the like, so that disengagement is achieved by rotating tubing 20 relative to the borehole while holding the insulators 36 and 52 by frictional engagement with the borehole or casing walls, for example.

Figure 4:
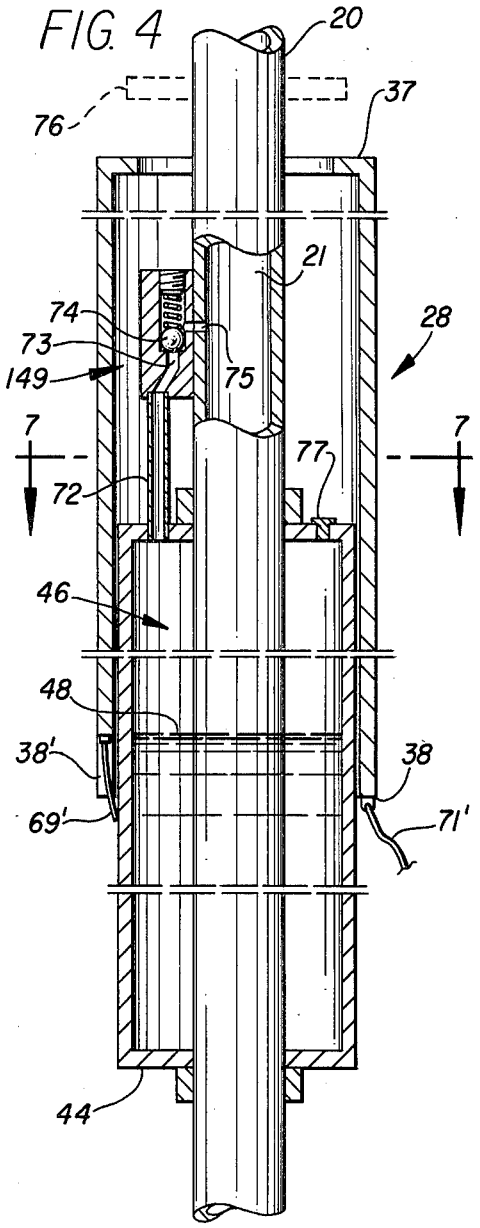
FIG. 4 is an enlarged, fragmented, part cross-sectional, detailed view of part of the apparatus disclosed in FIGS. 1 and 2.

FIG. 4 illustrates the details of one form of the invention which the upper member 28 can assume. The vapor phase 46 of the liquid nitrogen is connected to the illustrated relief valve 149 by means of a relatively small tubing 72. The tubing 72 conducts gaseous nitrogen flow into valve passageway 73. Spring loaded ball check valve 74 is biased against the illustrated seat, and when sufficient pressure is effected at 46, the ball is upset and flow occurs through tubing 72, passageway 73, across the ball and seat, through passageway 75, and into the interior of the tubing string.

Numeral 76 diagrammatically indicates a stop means which limits the upper travel of the insulated sleeve, with the upper edge portion 37 of the sleeve abuttingly engaging the stop means to thereby expose a predetermined, lower marginal length of the super-cooled stainless steel container. Numeral 77 is a frangible safety plug which ruptures prior to explosive failure of the container. Numeral 69' indicates a spring member which engages the upper end of the container, thereby holding the insulator in the opened position.

Figure 5:
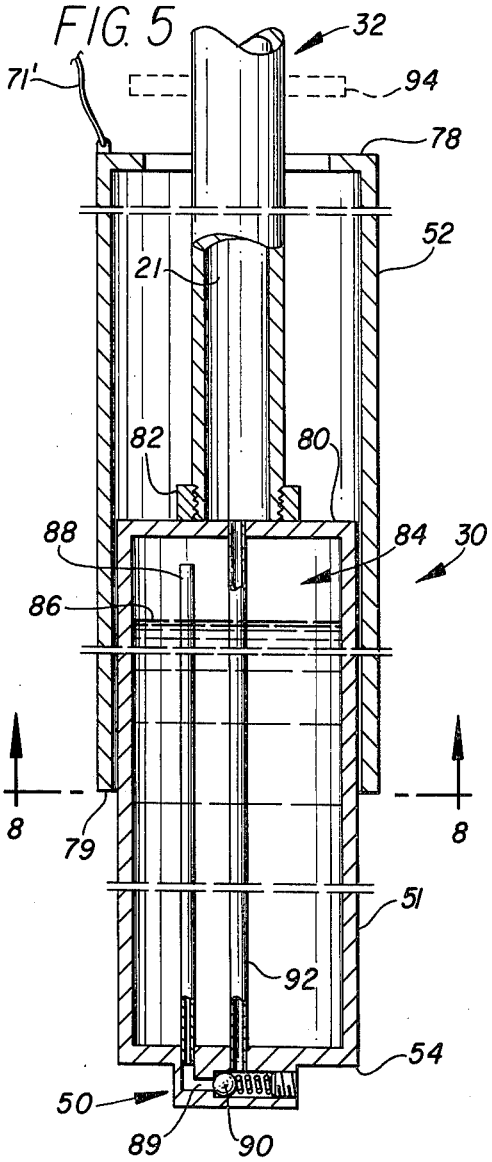
FIG. 5 is a fragmented, enlarged, part cross-sectional, detailed view of part of the apparatus disclosed in FIGS. 1 and 2.
Figure 7:
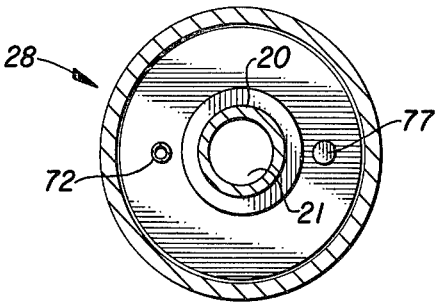
Figure 8:
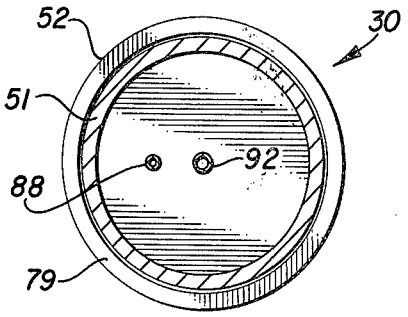

FIG. 5 sets forth the details of one embodiment of the lower vessel or freezing member 30. The insulated sliding enclosure 52 has an upper, circumferentially extending edge 78 spaced from a lower, circumferentially extending, cylindrical skirt 79. The upper end of the container is in the form of an annular wall 80 which is connected to the tubing by means of threaded connection 82. The container forms a chamber 84 within which liquid nitrogen or the like is stored to thereby form a liquid and vapor phase within the vessel having a liquid level 86.

Standpipe 88 is connected to inlet passageway 89 of the regulator valve 50. The valve includes a spring loaded ball 90 which is urged against the illustrated seat to thereby provide a regulated flow into the concentric outlet pipe 92. Hence, nitrogen vapor at 84 flows through standpipe 88, passageway 89, through the ball and seat, into the concentric pipe, and into the tubing string at 21, where the flow continues up through the nipple, through the upper vessel, and on up the tubing string to the surface of the ground where the nitrogen is vented to the atmosphere.

In operation, the freezing vessels 28 and 30 are assembled into the illustrated tool string of FIG. 1 and the interior thereof charged with liquid nitrogen or a similar liquified gaseous substance. The regulator valves 49 and 50 are preset to provide a maximum operating pressure within the upper and lower members so that vaporized nitrogen is controllably vented into the tubing 20 in order to reduce the vapor pressure thereof and thereby avoid exceeding the maximum designed strength of the tanks, while at the same time providing a suitable heat sink which will subsequently absorb sufficient heat to freeze the formation in the aforesaid manner.

The boiling point of nitrogen is −209° Centigrade at atmospheric pressure. The critical pressure of the nitrogen is 34.8 atmospheres while the critical temperature is 127° K. Hence, the vapor pressure of the nitrogen must be maintained within a desired range of pressure by the control valves 49 and 50 in order to achieve the desired temperature of the containers which in turn determines the rate of heat transfer into the vessel, and at the same time, avoids a vapor pressure which exceeds the structural integrity of the vessels.

The tool string is lowered into the borehole with the insulators extended about the vessels so that the formation 24 to be isolated is straddled by the upper and lower vessels 28 and 30. The sliding sleeve of the vent assembly is closed during this time so that the interior of the tubing 20 is maintained dry, with nitrogen venting into the tubing as may be required to maintain a suitable vapor pressure. The casing annulus is filled with liquid, such as drilling mud or salt water, to thereby enhance the thermal conductivity between the vessels and the adjacent, outlying strata. Next, a wireline tool is run downhole from the surface of the ground and the insulators moved to uncover the vessels. This places the vessels into intimate contact with the downhole fluids causing the temperature of areas 29 and 31 to be reduced below its freezing point to thereby freeze the two spaced areas and completely isolate the annulus 33. During this time nitrogen is being vented into the tubing string in proportion to the heat absorbed from the areas 29 and 31.

After the two spaced, frozen areas 29 and 31 have been achieved, a wireline tool is run down the tubing string and the sliding sleeve is opened. Chemical is next forced down the tubing 20, through the ports of the vent assembly, into the annulus 33, through the perforations 25, and laterally back up into the formation 24, to thereby confine the flow in a manner which limits the treatment to the formation under consideration. High pressure is usually employed along with propping agents and the like to cause the formation to subsequently give up its hydrocarbons.

After the formation 24 has been suitably treated, the apparatus is left downhole until the spaced apart, frozen masses have melted, whereupon the entire tool string can be removed from the borehole.

Any number of different treatment fluids can be utilized in treating the formation 24, including acids, cement, propping agents and the like.

The nitrogen vapor phase can be maintained at any desired pressure from atmospheric to several hundred psig, but preferably is adjusted or preset at about 500 psig. This value significantly reduces the evaporation rate of the liquid nitrogen and minimizes the evaporative losses subsequent to reaching a location several thousand feet below ground level, while at the same time enables employment of a container having a relatively thin wall thickness.

The danger of explosion or failure of the container is minimized with the hydrostatic or downhole pressure which often exceeds the selected 500 psig value. Hence it is possible to set the valves 49 and 50 at a value in excess of the breaking strength of the container, venting the nitrogen sufficiently to supercool the freezing vessel and contents thereof, and thereafter rapidly run downhole so that the hydrostatic head can be taken into account respective to the actual breaking strength of the vessels at the specific downhole location.

Figure 9:
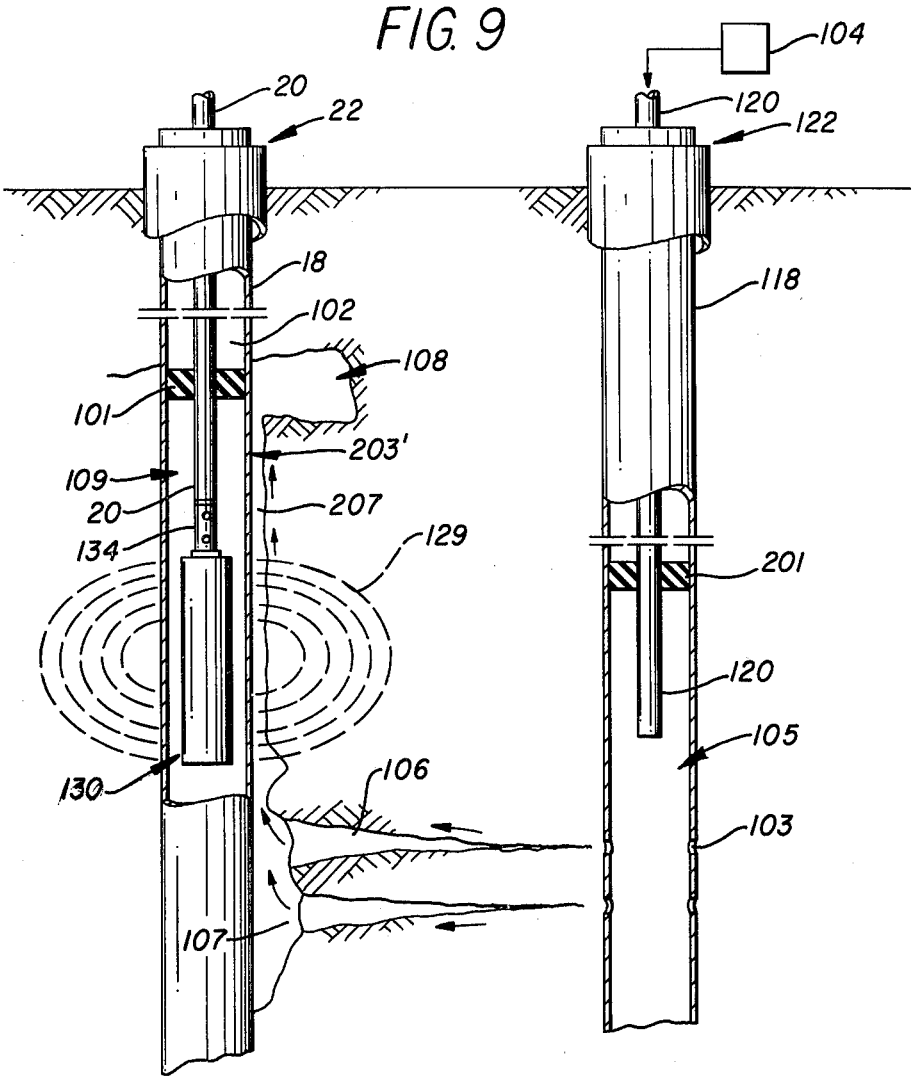
FIG. 9 is a broken, part cross-sectional view of another strata of the earth having boreholes formed therein with apparatus made in accordance with an alternate embodiment of the present invention included therein; and, FIG. 10 is a fragmentary representation of part of the borehole disclosed in FIG. 9.

In the embodiment of FIG. 9, a packer 101 separates an upper annulus 102 from a lower annulus 109 of the wellbore 18. Wellbore 118 includes a similar packer 201 which separates the perforated zone at 103 of the borehole from the upper casing annulus.

Water at 104 is injected into tubing string 120 so that the water flows into the lower borehole 105, where it is forced out of the perforations 103, and away from the well at 106. In actual practice, the injection well 122 forces water to flow into a preselected formation with the water extending radially away from the injection well in all directions.

In the illustration of FIG. 9, the water has flowed into proximity of the casing 18 where the injection water has then eroded a passageway 107 which extends up along the cemented casing at 207 and into a water-accepting area 108. The water-accepting area 108 sometimes is a washed-out salt zone, a leeched-out cavern, or an upper production zone. Sometimes the passageways 107 and 207 result from a poor cement job effected between the casing and the contiguous formation. Sometimes the tunneling is a result of the injection water solubilizing salt deposits.

Apparatus 130, made in accordance with the present invention, is filled with nitrogen as in the before described manner and run downhole on the end of the tubing string 20, the packer 101 is set, the vent string 134 is in the closed position, and the insulation about the freezing chamber is then removed from the freezing vessel 130 so that the contiguous area 129 is subsequently frozen. It is considered within the comprehension of this second embodiment of the invention to move the insulation from about container 130 simultaneously with or in response to the setting of the packer 101 by incorporating the teachings of my previously issued U.S. Pat. No. 3,871,448. In this instance, setting of the packer 101 removes the insulation 52 from about the metal container 51 by utilizing the downward movement of the packer mandrel respective to the packing elements thereof. Alternatively, the insulation can be wireline actuated prior to setting the packer.

After the zone 129 has been adequately frozen, a through tubing jet perforating gun is run downhole into proximity of area 203' so that the casing can be perforated at an area located between the frozen plug 129 and the packer 101.

The precise area which is perforated by the gun is previously determined by logging the well utilizing acoustical detectors to determine the cement bonding between the casing and the formation.

Figure 10:
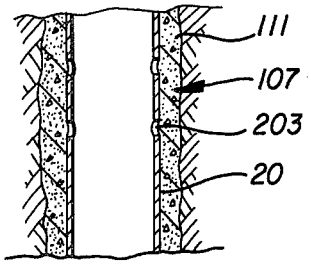

After the perforations 203 of FIG. 10 are formed, the vent string 134 of FIG. 9 is moved to the open position and cement is pumped into the annulus 109, and squeezed through the perforations 203 so that cement fills the void 107 and 207 as noted by numeral 111.

While cement 111 is used in the above example for a blocking agent at 207, it should be understood that other cementitious materials, including plastic and plastic-like material, as well as gels and swelling agents is intended to be included in the method of the present invention.

I claim:

1. Method of isolating and treating a hydrocarbon containing formation located downhole in a borehole comprising the steps of:

attaching spaced vessels to a tubing string, filling the vessels with a liquid having a high vapor pressure, thermally insulating the exterior of the vessels to thereby reduce vaporization of the liquid to a minimum, lowering the vessels into the borehole;

positioning one of the vessels uphole of the formation to be treated and positioning the other of the vessels downhole of the formation to be treated;

removing the insulation from the vessels so that the exterior thereof makes intimate contact with any fluid contained within the wellbore, thereby causing heat in proximity of the vessels to be absorbed by the vaporizing action of the liquid contained therewithin;

continuing to remove heat from above and below the formation to be treated until the well fluid and adjacent strata is frozen to form two spaced plugs, thereby isolating the formation to be treated;

pumping treatment fluid along a flow path which extends down through the tubing string, into the annulus between the two vessels and tubing string, and laterally away from the borehole and into the formation to be treated;

removing the vessels and tubing string from the borehole after the plugs have thawed.

2. The method of claim 1 and further including the steps of:

running the vessels into the borehole on the marginal lower end of the tubing string and extending the upper end of the tubing string to the surface of the earth so that treatment fluid can be pumped from the surface of the earth, into and down the tubing string to the lower marginal end thereof.

3. The method of claim 1 and further including the step of running the tubing string into the borehole dry and thereafter forming an opening in the tubing string at a location betweeen said vessels so that the treatment fluid can be pumped from the tubing string into the formation.

4. The method of claim 1 wherein the step of pumping treatment fluid down the tubing string and into the formation is accomplished by interposing a vent assembly between the vessels and opening the vent assembly by running a wire line actuated tool down the tubing string into contact with the vent assembly.

5. The method of claim 1 wherein the insulation is removed from the vessels by running a wire line actuated tool down the wellbore annulus between the tubing string and the casing, and thereafter pumping treatment fluid down the tubing string by interposing a vent assembly between the vessels, and opening the vent assembly by running a wire line actuated tool down the tubing string into operative contact with the vent assembly.

6. The method of claim 5 and further including the step of maintaining the vapor pressure of the liquid contained within the vessel at a constant reduced pressure by venting the vapor phase thereof into the tubing string and venting the tubing string to ambient until it is necessary to pump treatment fluid down the tubing string.

7. The method of claim 1 and further including the step of forming an isolated flow path from the lower end of the tubing string to the atmosphere and flowing vaporized liquid from the vessels into the tubing string and up the tubing string into the atmosphere, thereby maintaining the vapor pressure of the liquid contained within the vessels at a predetermined minimum pressure which is less than the vapor pressure thereof so that sufficient cooling occurs to form the frozen plugs;

removing the insulation by a wireline which is run down casing annulus and into operative relationship with said insulation;

forming said lateral flow path by opening a vent assembly with a wireline which is run down the interior of the tubing string into operative engagement with said vent assembly.

8. Apparatus by which a production formation within a wellbore can be isolated and treated by freezing the well fluids and adjacent strata at spaced locations above and below said production formation so that treatment fluid can subsequently be pumped into said production formation, said apparatus comprises;

an upper and a lower vessel within which nitrogen or the like can be stored; a tubing string, a vent assembly; said tubing string extends from the surface of the earth, downhole to proximity of the production formation, said vent assembly being formed on the lower marginal end of said tubing string, said upper and lower vessels being connected to the lower marginal end of said tubing string with said vent assembly being located between said vessels;

means by which said vent assembly can be moved from a closed to an opened position by a wire line fishing tool, thereby enabling the interior of the tubing string to remain dry until the vent assembly is moved to the open position;

means insulating said vessels such that heat transfer thereto is minimized, means for removing said means insulating said vessels such that heat transfer thereto is maximized;

each said vessel having a vapor space and a liquid space when filled with liquid nitrogen or the like; pressure regulator means by which the vapor space of each vessel is vented into the interior of said tubing string such that the vapor pressure of the liquid contained within the vessels is maintained at a predetermined value which is below the breaking strength of the vessel, while the vapors are vented up the interior of the tubing string and into the atmosphere;

whereby, said vessels may be lowered on the end of the tubing string and positioned to straddle the production formation to be treated, said insulators are moved to expose the vessels to well fluid while said nitrogen is vaporized and vented to atmosphere to reduce the temperature of the immediate area and thereby form spaced plugs, and said vent assembly can thereafter be moved to the opened position to enable treatment fluid to be pumped down the tubing string and laterally from the tubing string into the production formation.

9. The apparatus of claim 8 wherein said insulators include means by which they are moved respective to said vessels by a wire line tool actuated from the surface of the ground, and said vent assembly includes means by which it is moved to the open position by a through-tubing wire line actuated tool.

10. The apparatus of claim 8 wherein each said vessel is cylindrical and of a diameter less than the diameter of the wellbore so that the vessels can be lowered into proximity of the formation to be treated;

said vessels being axially aligned respective to one another and to said tubing string and said insulators;

said insulators being cylindrical and encapsulating said vessels until the insulators are moved away from said vessels;

said insulators include means by which they are moved respective to said vessels by a wire line tool actuated from the surface of the ground, and said vent assembly includes means by which it is moved to the open position by a through-tubing wire line actuated tool.

11. In a cased borehole having an upper and lower zone communicated by a flow passageway in proximity of and externally of the casing, the method of cementing off the flow passageway communicating one zone with the other, comprising the steps of:

attaching an insulated vessel to a tubing string by using a vent assembly, filling the vessel with a liquid having a high vapor pressure, placing a packer on the tubing string uphole of the vent assembly, and running the vessel into the borehole and positioning the vessel at a location between the upper and lower zones;

removing the insulation from the vessel so that the exterior thereof makes intimate contact with any fluid contained within the wellbore, thereby causing heat in proximity of the vessel to be absorbed by the vaporizing action of the liquid contained therewithin;

continuing to remove heat until the well fluid and adjacent strata is frozen to form a plug, thereby temporarily preventing flow from one of said upper and lower zones to the other;

perforating the casing at a location above the frozen area and below said upper zone;

opening the vent string and pumping cementitious material down the tubing string, through the vent assembly, into the annulus between the tubing and casing, through the perforations, and into the passageway which communicate the upper and lower zones, thereby filling the passageway with cementitious material to prevent subsequent flow therethrough;

removing the vessel along with the packer and vent string from the borehole after the frozen well fluid has thawed.

* * * * *